US006244900B1

(12) United States Patent
Ishikawa et al.

(10) Patent No.: US 6,244,900 B1
(45) Date of Patent: Jun. 12, 2001

(54) ELECTRICAL CONNECTOR WITH REDUNDANT PREVENTION OF EXCESSIVE FORWARD MOVEMENT OF A TERMINAL FITTING IN A CAVITY OF A CONNECTOR HOUSING

(75) Inventors: Ryotaro Ishikawa; Hajime Kawase; Satoru Nishide, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/376,223

(22) Filed: Aug. 17, 1999

(30) Foreign Application Priority Data

Aug. 20, 1998 (JP) ..... 10-234597

(51) Int. Cl.[7] ..... H01R 13/40
(52) U.S. Cl. ..... 439/595; 439/744; 439/752.5
(58) Field of Search ..... 439/595, 744, 439/752.5

(56) References Cited

U.S. PATENT DOCUMENTS

| | | | | |
|---|---|---|---|---|
| 5,613,878 | * | 3/1997 | Tsuji et al. | 439/595 |
| 5,645,452 | * | 7/1997 | Kodama | 439/595 |
| 5,730,625 | * | 3/1998 | Sikora | 439/595 |
| 5,743,771 | | 4/1998 | Yamaguchi et al. . | |
| 5,859,534 | * | 1/1999 | Saijo et al. | 439/595 |
| 5,885,106 | * | 3/1999 | Genta et al. | 439/595 |
| 5,910,031 | * | 6/1999 | Goto | 439/752.5 |
| 5,944,558 | * | 8/1999 | Iwahori | 439/595 |
| 6,068,524 | * | 3/2000 | Kouatsu | 439/752.5 |

FOREIGN PATENT DOCUMENTS

| | | |
|---|---|---|
| 0 657 963 | 6/1995 | (EP) . |
| 4-220970 | 8/1992 | (JP) . |

* cited by examiner

*Primary Examiner*—Brian Sircus
*Assistant Examiner*—Hae Moon Hyeon
(74) *Attorney, Agent, or Firm*—Anthony J. Casella; Gerald E. Hespos; Michael J. Porco

(57) ABSTRACT

A connector is provided to increase the strength for stopping a forward movement of a terminal fitting. The connector has a housing 11 with a cavity 12. A locking portion 18 is disposed in the cavity 12. Opposite side surfaces of a portion of a locking portion 18 more toward the leading end thereof than a locking projection 19 are cut off to form cut surfaces 21. Contact portions 23 projecting inward are formed continuously with a front wall 13 in areas of side surfaces of the cavity 12 facing the cut surfaces 21. Stabilizers 8 provided on a male terminal fitting 1 can come into contact with the back edges of the contact portions 23. A forward movement of the male terminal fitting 1 properly inserted is stopped by the contact with the front wall 13 and the contact of the stabilizers 8 with the contact portions 23. Since the contact portions 23 are formed taking advantage of spaces obtained by cutting off parts of the locking portion 18, they do not cause any enlargement of the cavity 12. Further, this portion of the locking portion 18 toward the leading end thereof from the locking projection 19 has almost no influence on the strength for locking the terminal fitting 1 so as not to be withdrawn backward, and the same degree of a locking force against the backward movement of the terminal fitting 1 as the locking portion of the prior art connector described above can be secured.

6 Claims, 7 Drawing Sheets

ELECTRICAL CONNECTOR WITH REDUNDANT PREVENTION OF EXCESSIVE FORWARD MOVEMENT OF A TERMINAL FITTING IN A CAVITY OF A CONNECTOR HOUSING

BACKGROUND OF THE INVENTION

1. Field of the Invention

The present invention relates to a connector and is particularly designed to strengthen a front-stop construction for a terminal fitting inserted into a cavity.

2. Description of the Related Art

A known construction for mounting a terminal fitting in a connector is shown in FIG. 11. In this example, the prior art connector is a male connector. The prior art connector has a male terminal fitting a with a tab c that projects from the front surface of a box-shaped main body b. A wire d is connected with the rear end of the main body b, and a locking hole e is formed in the bottom surface of the main body b. The prior art connector further includes a male connector housing f with a cavity g into which the male terminal fitting a is insertable from behind. A front wall h is formed at the front surface of the cavity g. The front wall h has an opening i through which the tab c of the male terminal fitting a is projectable. Alternatively, a jig may be insertable into the opening I to disengage the terminal fitting a. A locking portion j is formed in the bottom surface of the cavity g. The locking portion j has a locking projection k that is fittable into the locking hole e of the male terminal fitting a and that projects forwardly with the leading end hanging free so as to be elastically deformable.

The male terminal fitting a is pushed forwardly during insertion into the cavity g. The pushing of the male terminal fitting a elastically deforms the locking portion j and the forward movement of the male terminal fitting a stops when the front surface of the main body b comes into contact with the front wall h. Simultaneously, the locking portion j is restored elastically to its original shape and the locking projection k thereof is fitted into the locking hole e. In other words, the male terminal fitting a has its forward movement stopped by the front wall h of the cavity g while being locked by the locking portion j so as not to be withdrawn backwardly.

As described above, the forward movement of the male terminal fitting a inserted into the cavity g is stopped by the contact of the front surface of the main body b with the front wall h, specifically with an opening edge at the rear side of the opening i. However, since the tab c is a narrowed part of the male terminal fitting a, the front surface of the main body b continuous with the base of the tab c is tapered. Accordingly, a portion of the front surface of the main body b which acts for the front-stop of the terminal fitting a is limited to such a narrow portion m hatched in FIG. 12, which presents a problem of insufficient locking strength. Thus, for example, if an impact force would act on the male terminal fitting a in forward direction, the male terminal fitting a might jump out forwardly by breaking or tearing the front wall h.

To strengthen the front-stop construction without changing the overall size of the cavity g and/or the shape of the terminal fitting a, it may be considered, for example, to cause the portion substantially acting for the front-stop of the terminal fitting to bulge inwardly. However, this obliges the width of the locking portion j to be reduced, thereby reducing a force for locking the terminal fitting a so as not to be withdrawn backwardly. Therefore, the above problem cannot easily be coped with by this measure.

The present invention was developed in view of the above problem and an object thereof is to increase a strength for stopping a forward movement of a terminal fitting without substantially affecting a locking force of a locking portion.

SUMMARY OF THE INVENTION

The subject invention is directed to a connector which comprises a connector housing. The connector housing has at least one cavity into which at least one terminal fitting is at least partly insertable from behind. The connector housing has a front wall with an opening at the front surface of the cavity. The connector housing also has an elastically deformable locking portion with a locking projection that is fittable into a locking hole formed in the terminal fitting. The elastically deformable locking projection is formed in one side surface of the cavity and projects forwardly with the leading end hanging free. Thus the terminal fitting has its forward movement stopped by the front wall and is locked by the locking portion so as not to be withdrawn backwardly. At least one side surface of a portion of the locking portion more toward the leading end thereof than the locking projection is cut off to form a cut surface. Additionally a contact portion to be brought into contact with an engaging portion on the terminal fitting projects inwardly from a corresponding side surface of the cavity that corresponds to or faces the cut surface. At least one contact portion to be brought into contact with at least one engaging portion on the terminal fitting bulges out from a side surface of the locking portion.

Preferably, there is a connector with a connector housing that has a cavity into which a terminal fitting is insertable from behind. A front wall with an opening is formed at the front surface of the cavity. An elastically deformable locking portion is formed in one side surface of the cavity, and projects forwardly with the leading end hanging free. The elastically deformable locking portion has a locking projection that is fittable into a locking hole in the terminal fitting. Thus the terminal fitting has its forward movement stopped by the front wall and is locked by the locking portion so as not to be withdrawn backwardly. At least one side surface of a portion of the locking portion more toward the leading end thereof than the locking projection is cut off to form a cut surface, and a contact portion to be brought into contact with an engaging portion provided on the terminal fitting projects inwardly from a corresponding side surface of the cavity facing the cut surface.

The terminal fitting inserted into the cavity has its forward movement stopped by the contact with the front wall of the cavity and the contact of the engaging portion with the contact portion on the side surface of the cavity. This strengthens a locking force against the forward movement of the terminal fitting and prevents the terminal fitting from projecting forwardly by more than a specified distance. Further, since the contact portion is formed taking advantage of a space obtained by cutting off a portion of the locking portion, it does not cause any enlargement of the cavity. The portion of the locking portion more toward the leading end than the locking projection has almost no influence on the strength for locking the terminal fitting so as not to be withdrawn backward, and the same degree of the locking force against the backward withdrawing movement of the terminal fitting as the prior art described above can be secured.

The portion of the locking portion more toward the leading end thereof than the locking projection preferably is narrowed to have a step-like shape. This portion of the locking portion more toward the leading end thereof than the locking projection is used to disengage the locking portion from the terminal fitting by pressing the locking portion with a jig or the like to deform it elastically. In this invention, the leading end of the locking portion is narrowed by cutting off the side surface to have a step-like shape, i.e. to have a rectangular cross section. Accordingly, as compared to a case where the side surface of the leading end of the locking portion is so cut off as to, for example, have a triangular cross section, the leading end of the locking portion has a larger strength against the jig pressed to disengage the locking portion.

Further preferably, there is provided a connector with a connector housing. The connector housing has a cavity into which a terminal fitting is insertable from behind. A front wall with an opening is formed at the front surface of the cavity. An elastically deformable locking portion is formed in one side surface of the cavity and projects forwardly with the leading end hanging free. A locking portion is formed on the elastically deformable locking portion and is engageable in a locking hole formed in the terminal fitting. The terminal fitting has its forward movement stopped by the front wall and is locked by the locking portion so as not to be withdrawn backwardly. A contact portion to be brought into contact with an engaging portion on the terminal fitting bulges out from a side surface of the locking portion.

The terminal fitting inserted into the cavity has its forward movement stopped by the contact with the front wall of the cavity and the contact of the engaging portion with the contact portion on the side surface of the locking portion. This strengthens a locking force against the forward movement of the terminal fitting and prevents the terminal fitting from projecting forward by more than a specified distance. Since the contact portion is formed to take advantage of a space already present on the side of the locking portion, it does not cause any enlargement of the cavity, and the same degree of the locking force against the backward withdrawing movement of the terminal fitting as the prior art described above can be secured.

The engaging portion of the terminal fitting may be a stabilizer for preventing an upside-down insertion of the terminal fitting. Since the stabilizer for preventing an upside-down insertion of the terminal fitting is used as the engaging portion, the problem of the prior art connector can be coped with without changing the shape of the terminal fitting.

Still further preferably, the engaging portion(s) of the terminal fitting come(s) into contact with the contact portion (s) at substantially the same time when the terminal fitting comes into contact with the front wall of the connector housing.

Most preferably, the one or more contact portions are formed in areas substantially corresponding to the portions where the cut surfaces are formed.

These and other objects, features and advantages of the present invention will become more apparent upon a reading of the following detailed description and accompanying drawings.

DETAILED DESCRIPTION OF THE PREFERRED EMBODIMENTS

Figure 1:
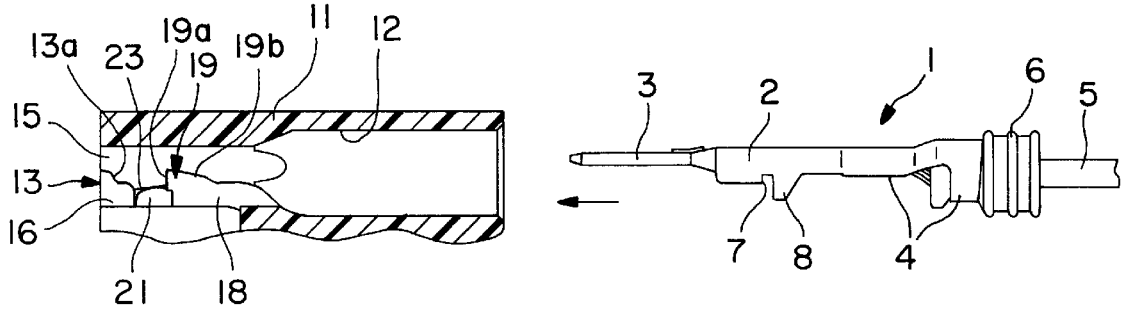
FIG. 1 is a section of a male housing according to a first embodiment of the invention before a male terminal fitting is inserted.
Figure 2:
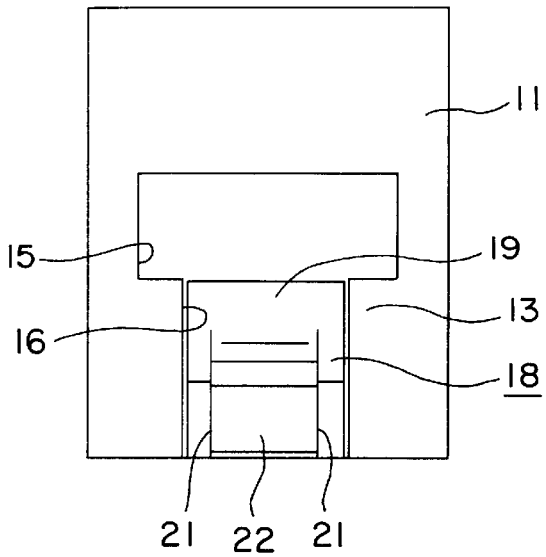
FIG. 2 is a front view of the male housing.
Figure 3:
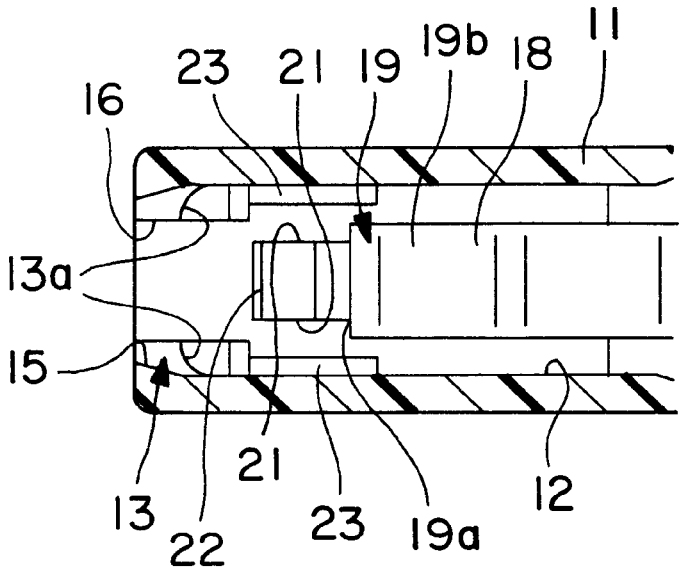
FIG. 3 is a plan view in section of the male housing.
Figure 4:
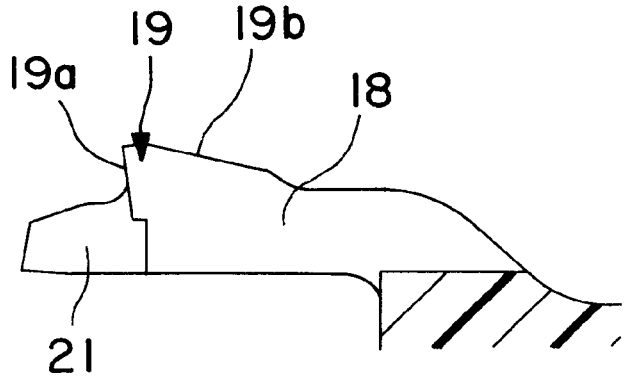
FIG. 4 is a side view of a locking portion.

A first embodiment of the invention is described with reference to FIGS. 1 to 6. In this embodiment, the invention is applied to a male watertight connector. Here front/back corresponds to the forward/rearward part as seen in a direction of insertion of a terminal fitting into a connector housing.

A male terminal fitting 1 is formed e.g. by pressing a conductive metal plate and is constructed such that a tab 3 projects from the front surface of a substantially box-shaped main body 2. An end of a wire 5 and a rubber plug 6 are connected to the male terminal fitting 1 by a barrel 4 provided at the rear end of the main body 2. A locking hole 7 is formed in the bottom surface of the main body 2 and will receive a locking projection 19 of a locking portion 18 to be described later. A pair of stabilizers 8 project from the bottom edges of side surfaces of the main body 2 at the opposite sides of the locking hole 7 and prevent an inverted or upside-down insertion of the terminal fitting 1.

On the other hand, a male connector housing 11 (hereinafter, merely "male housing") is provided with a cavity 12 into which the above male terminal fitting 1 is at least partly insertable preferably from behind. A preferably round hole into which the rubber plug 6 is fittable is formed at the rear end of the cavity 12, and a preferably rectangular hole into which the main body 2 of the male terminal fitting 1 is fittable is formed at the front end of the cavity 12. A front wall 13 is formed at the front surface of the cavity 12 and has a rearwardly facing stop surface 13*a*. The front wall 13 is formed with a tab insertion opening 15 through which the tab 3 of the male terminal fitting 1 is projectable and a jig insertion opening 16 which is provided below the tab insertion opening 15 and communicates therewith. The jig insertion opening 16 is slightly narrower than the tab insertion opening 15 and is open in the bottom surface of the front wall 13.

The locking portion 18 for locking the terminal fitting 1 so as not to be withdrawn e.g. backward is provided in or at the bottom wall of the cavity 12. The locking portion 18 preferably projects forwardly in the middle of the bottom wall of the cavity 12 with respect to the widthwise direction. Additionally, the leading end of the locking portion 18 hangs free and to has a width slightly smaller than that of the jig insertion opening 16. The leading end of the locking portion 18 reaches the inner surface of the front wall 13, and is elastically deformable in a lateral direction, e.g. downward about the base end thereof. A locking projection 19 projects from the upper surface of the locking portion 18, and is fittable into the locking hole 7 of the male terminal fitting 1. The locking projection 19 includes a forwardly facing lock surface 19*a* and a rearwardly facing ramped face 19*b*.

Figure 5:
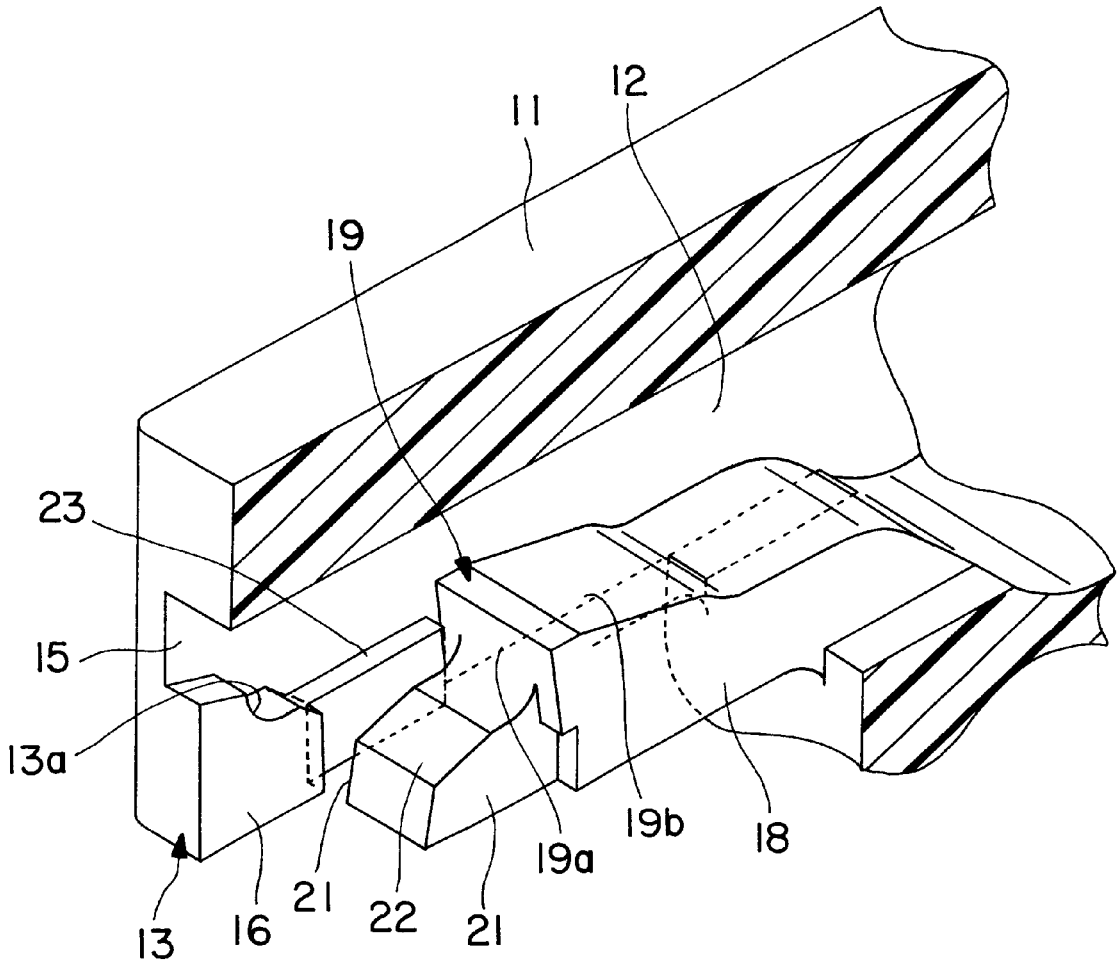
FIG. 5 is a perspective view showing the inner construction of a cavity.

The opposite side surfaces of the locking portion 18 are cut off by a specified distance between the bottom end of the locking projection 19 and the leading end of the locking portion 18, thereby forming cut surfaces 21 (see e.g. FIG. 5). On the other hand, bottom parts of the opposite side surfaces of the cavity 12 have contact portions 23 that project inwardly by a specified distance in areas substantially corresponding to the portions where the cut surfaces 21 are formed. The contact portions 23 are formed continuously with the inner surface of the front wall 13, and the back end positions thereof are such that the stabilizers 8 come into contact therewith when the male terminal fitting 1 is inserted to its proper insertion position, as described later.

Figure 6A:
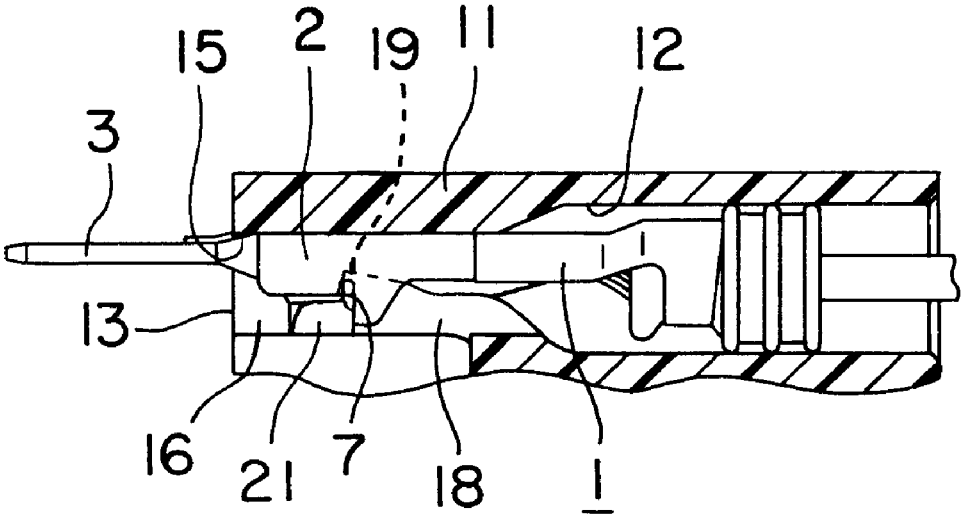
FIGS. 6(A) and 6(B) are sections showing a state where the male terminal fitting is inserted into the cavity.
Figure 6B:
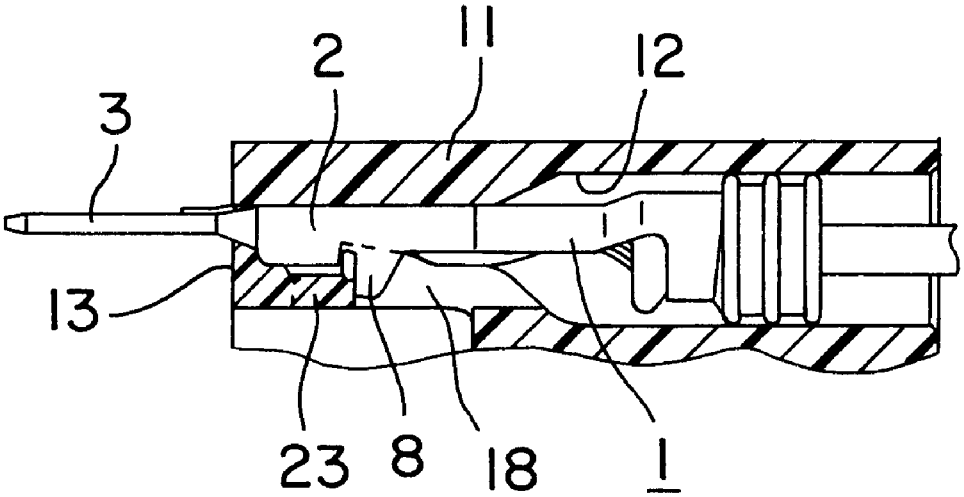
Figure 7:
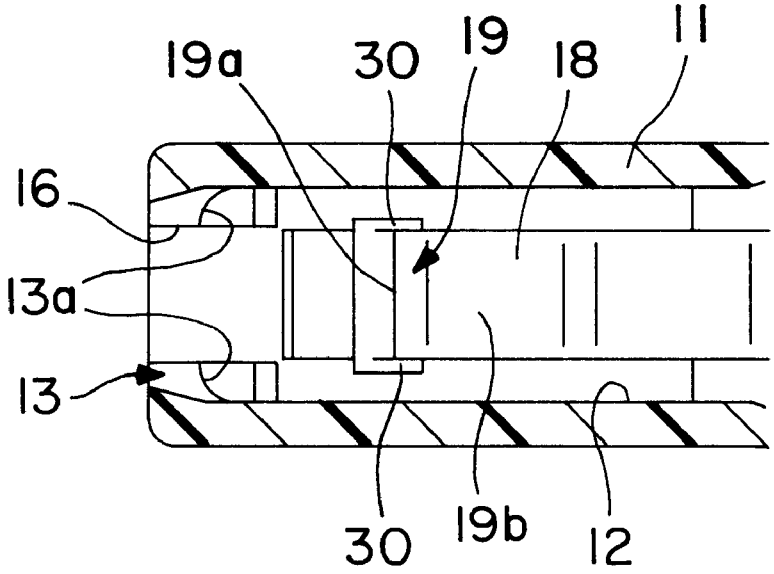
FIG. 7 is a plan view in section of a male housing according to a second embodiment.
Figure 8:
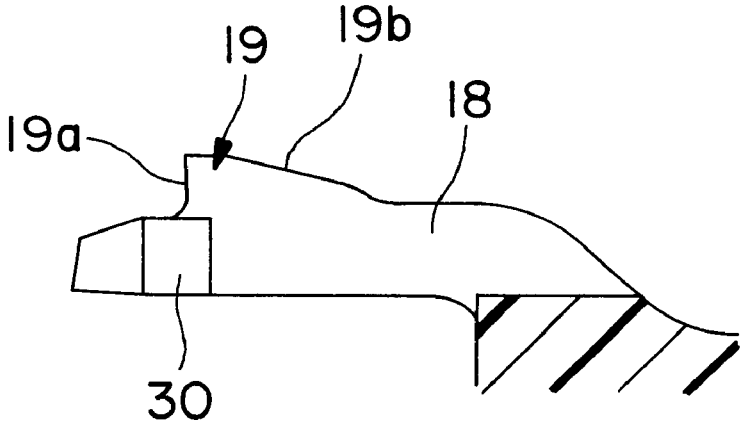
FIG. 8 is a side view of a locking portion.
Figure 9:
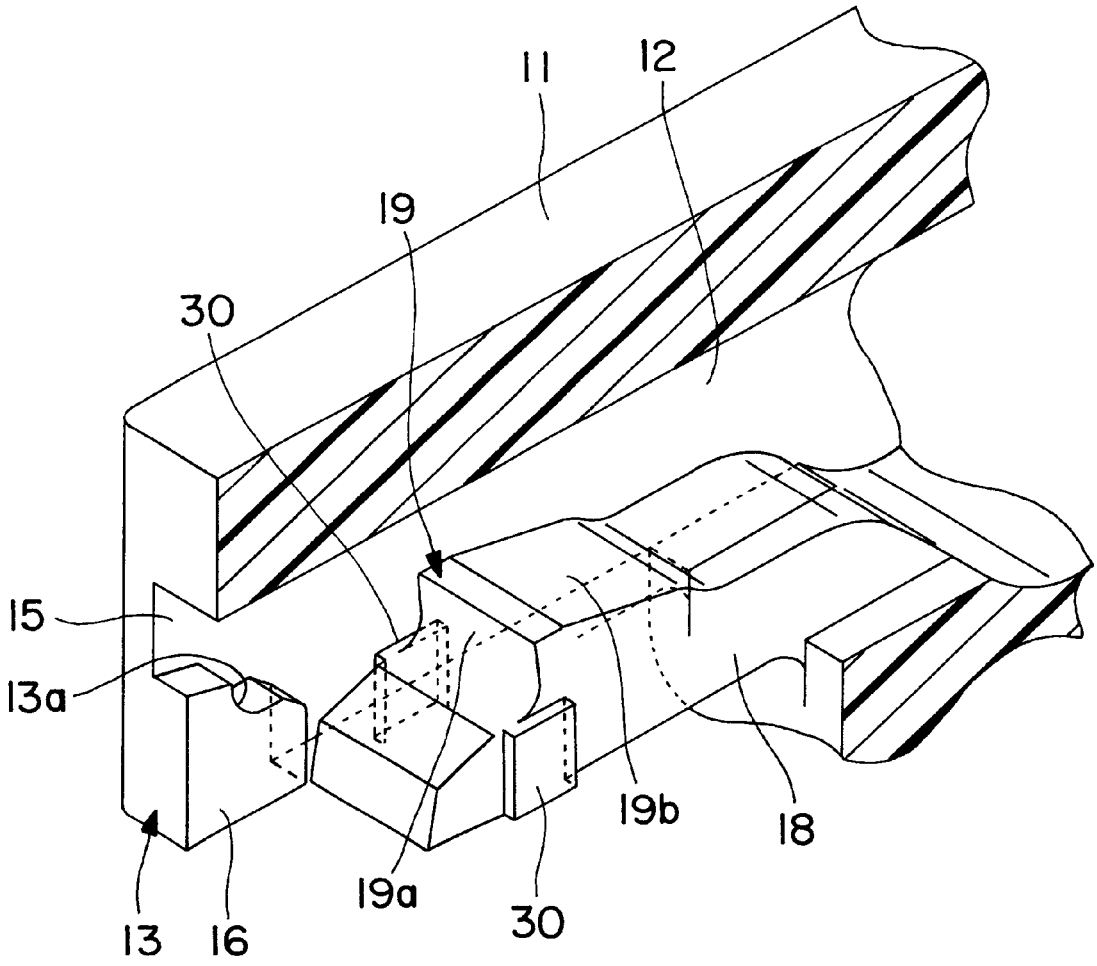
FIG. 9 is a perspective view showing the inner construction of a cavity.

This embodiment described above operates as follows. During the insertion of the male terminal fitting 1 into the cavity 1 2 from behind, as indicated by an arrow in FIG. 1, the bottom end of the front surface of the main body 2 comes into contact with the rear side of the locking projection 19 of the locking portion 18, thereby elastically deforming the leading end of the locking portion 18 downwardly. Then, the male terminal fitting 1 is pushed until the tab 3 projects forwardly through the tab insertion opening 15. As shown in FIG. 6, the insertion of the male terminal fitting 1 is stopped when the front surface of the main body 2 substantially contacts the front wall 13, and the locking projection 19 is fitted into the locking hole 7 upon the elastic restoration of the locking portion 18 substantially to its original shape. As a result the male terminal fitting 1 is locked and can not be withdrawn backwardly. At this time, the stabilizers 8 of the male terminal fitting 1 are both substantially in contact with the back ends of the left and right contact portions 23 as shown in FIG. 6(B).

The male terminal fitting 1 inserted substantially to its proper insertion position in the cavity 12 has its forward movement stopped by contact of the front surface of the main body 2 with the front wall 13 of the cavity 12 and the contact of the stabilizers 8 with the contact portions 23 at the opposite side surfaces of the cavity 12. Thus, a locking force against the forward movement of the male terminal fitting 1 is strengthened.

In the case that the male terminal fitting 1 is withdrawn from the cavity 12 for the maintenance or the like, a jig is inserted through the jig insertion opening 16 to press the upper surface of a narrowed leading end portion 22 of the locking portion 18. If the locking portion 18 is deformed elastically with force until the locking projection 19 comes out of the locking hole 7, the male terminal fitting 1 can be withdrawn backward.

As described above, this embodiment is constructed such that the forward movement of the male terminal fitting 1 is stopped by the contact of the main body 2 with the front wall 13 and the contact of the stabilizers 8 with the contact portions 23. Accordingly, the locking force against the forward movement of the terminal fitting 1 is strengthened considerably. For example, even if an impact force acts on the male terminal fitting 1 to cause it to project forwardly, an event where the male terminal fitting 1 jumps out forward by breaking or tearing the front wall 13 can be prevented from occurring.

Further, the contact portions 23 are formed to take advantage of the spaces obtained by cutting off the portions of the locking portion 18, and hence do not cause any enlargement of the cavity 12. The cut portion of the locking portion 18 more toward the leading end than the locking projection 19 has no substantial influence on the strength required to lock the male terminal fitting 1 to prevent backward withdrawal. Furthermore, the section of the locking portion 18 from the locking projection 19 to the rear end, which section acts to lock the male terminal fitting 1, has the same width as the locking portion of the prior art connector. Therefore, substantially the same degree of the locking force against the backward movement of the terminal fitting as the locking portion of the prior art connector can be secured.

Further, the leading end of the locking portion 18 is narrowed by cutting off the side surfaces to have a step-like shape, i.e. to have a rectangular cross section.

Accordingly, as compared to a case where the side surfaces of the leading end of the locking portion 18 are cut off to have, for example, a triangular cross section, the leading end of the locking portion 18 has a larger strength against the jig pressed to disengage the locking portion 18.

FIGS. 7 to 10 show a second embodiment of the invention. In the second embodiment, a change is made in the strengthened front-stop construction for the male terminal fitting.

First, left and right stabilizers 8A provided on the male terminal fitting 1 are spaced apart by substantially the same distance as or somewhat bigger than the width of the locking portion 18. During the insertion of the male terminal fitting 1 into the cavity 12, these stabilizers 8A are moved while holding the opposite side surfaces of the locking portion 18 therebetween.

Contact portions 30 project outwardly by a specified distance and are integrally or unitarily formed on the left and right side surfaces of the locking portion 18 below the locking projection 19. The back end portions of the contact portions 30 are such that the stabilizers 8A come into contact therewith when the male terminal fitting 1 is inserted to its proper insertion position.

Figure 10:
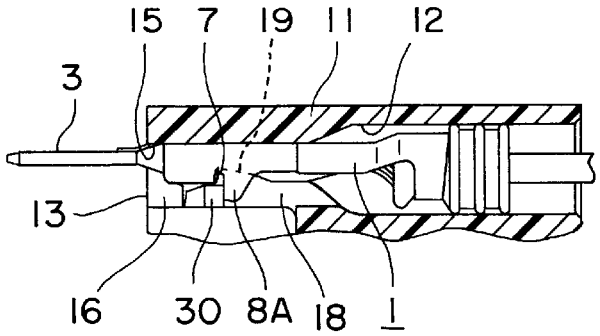
FIG. 10 is a section showing a state where a male terminal fitting is inserted into the cavity.
Figure 11:
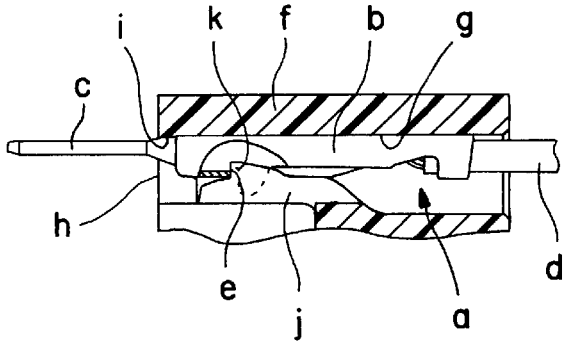
FIG. 11 PRIOR ART
FIG. 11 is a section of a prior art male housing into which a male terminal fitting is inserted.
Figure 12:
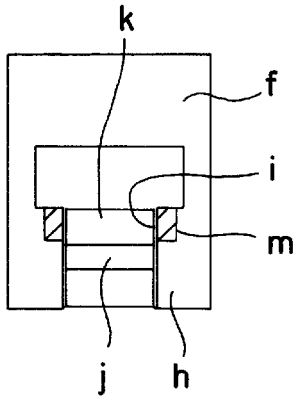
FIG. 12 PRIOR ART
FIG. 12 is a front view of the prior art male housing.

In the second embodiment, the male terminal fitting 1 is inserted into the cavity 4 while elastically deforming the leading end of the locking portion 18 downwardly and moving the stabilizers 8A with the locking portion 18 held therebetween. The insertion of the male terminal fitting 1 is stopped when the front surface of the main body 2 comes into contact with the front wall 13 as shown in FIG. 10, and the locking projection 19 is fitted into the locking hole 7 upon the elastic restoration of the locking portion 18 substantially to its original shape, with the result that the male terminal fitting 1 is locked so as not to be withdrawn backwardly. At this time, the stabilizers 8A of the male terminal fitting 1 are both substantially in contact with the back ends of the contact portions 30 on the side surfaces of the locking portion 18.

Specifically, the male terminal fitting 1 inserted to its proper insertion position in the cavity 12 has its forward movement stopped by the contact of the front surface of the main body 2 with the front wall 13 of the cavity 12 and the contact of the stabilizers 8A with the contact portions 30 on the opposite side surfaces of the locking portion 18. Thus, a locking force against the forward movement of the male terminal fitting 1 is strengthened.

Further, the contact portions 30 bulge out from the side surfaces of the locking portion 18 and a portion of the locking portion 18 acting to lock the male terminal fitting 1 has the same width as the locking portion of the prior art connector described above. Therefore, substantially the same degree of the locking force against the backward movement of the terminal fitting as the locking portion of the prior art connector can be secured.

The present invention is not limited to the described and illustrated embodiment but, for example, the following embodiments also are embraced by the technical scope of the present invention as defined in the claims. Besides the following embodiments, a variety of other changes can be made without departing from the scope and spirit of the invention as defined in the claims.

Depending on the kinds of terminal fittings, the stabilizer is provided at only either left or right side. For such a terminal fitting, the contact portion may be formed only on one corresponding surface of the cavity or locking portion.

For terminal fittings not formed with stabilizers, engaging portions to be brought into contact with the contact portions may be additionally provided.

The present invention is applicable not only to male connectors illustrated in the foregoing embodiment, but also to female connectors.

What is claimed is:

1. A connector comprising:

a connector housing with opposed front and rear ends, at least one cavity extending through the housing from the rear end to the front end and defining opposite front and rear openings to the cavity, the cavity being defined partly by a pair of opposed side walls, a front wall projecting in the cavity at the front end of the housing, the front wall having a rearwardly facing stop surface, an elastically deformable locking portion cantilevered from a location in the cavity rearwardly of the front wall and projecting toward the front of the connector housing, the elastically deformable locking portion being spaced inwardly from the side walls to define side spaces on each side of the elastically deformable locking portion, a forwardly facing lock surface formed on the locking portion at a location rearwardly of the stop surface on the front wall, at least one rearwardly facing contact portion in the cavity at a location rearwardly of the front wall and projecting into at least one of the side spaces; and at least one terminal fitting disposed in the cavity, the terminal fitting having a main body with a front end engaged against the rearwardly facing stop surface of the front wall in the cavity, a hole formed in the terminal fitting, the locking portion being engaged in the hole such that the forwardly facing lock surface of the locking portion prevents rearward movement of the terminal fitting from the connector housing, and at least one engaging portion projecting from the main body and being slidably disposed in the at least one side space, the engaging portion being dimensioned to be engaged against the contact portion, whereby engagement of the terminal main body with the rearwardly facing stop surface of the front wall limits forward movement of the terminal fitting in the cavity, and whereby the engagement of the engaging portion with the rearwardly facing contact portion redundantly prevents forward movement of the terminal fitting in the cavity.

2. The connector of claim 1, wherein the at least one contact portion comprises a pair of contact portions, projecting into the respective side spaces, the at least one engaging portion comprising a pair of engaging portions slidably disposed in the respective side spaces for contacting the respective contact portions.

3. The connector of claim 1, wherein the elastically deformable locking portion includes a ramped face facing rearwardly, whereby the ramped surface enables elastic deflection of the elastically deformable locking portion during insertion of the terminal fitting into the cavity.

4. The connector of claim 1, wherein the rearwardly facing stop surface of the front wall is spaced from the rearwardly facing contact portion by a distance substantially equal to a distance between the front end of the main body of the terminal fitting and the engaging portion of the terminal fitting, such that the front wall and the contact portion of the connector housing are engaged substantially simultaneously by the terminal fitting.

5. A connector according to claim 1, wherein the rearwardly facing contact portion is formed on a surface of the connector housing spaced laterally from the elastically deformable locking portion.

6. A connector according to claim 1, wherein the rearwardly facing contact portion formed on the elastically deformable locking portion.

* * * * *